US008926373B2

(12) United States Patent
Flachslaender

(10) Patent No.: US 8,926,373 B2
(45) Date of Patent: Jan. 6, 2015

(54) MALE CONNECTOR, FEMALE CONNECTOR AND CONNECTOR ARRANGEMENT

(75) Inventor: Erwin Flachslaender, Calw (DE)

(73) Assignee: Koninklijke Philips N.V., Eindhoven (NL)

( * ) Notice: Subject to any disclaimer, the term of this patent is extended or adjusted under 35 U.S.C. 154(b) by 39 days.

(21) Appl. No.: 13/520,795

(22) PCT Filed: Jan. 7, 2011

(86) PCT No.: PCT/IB2011/050064

§ 371 (c)(1),
(2), (4) Date: Jul. 6, 2012

(87) PCT Pub. No.: WO2011/083437

PCT Pub. Date: Jul. 14, 2011

(65) Prior Publication Data

US 2013/0059482 A1 Mar. 7, 2013

(30) Foreign Application Priority Data

Jan. 11, 2010 (EP) ..... 10150439

(51) Int. Cl.

| | |
|---|---|
| ***H01R 24/00*** | (2011.01) |
| ***H01R 12/70*** | (2011.01) |
| ***H01R 13/44*** | (2006.01) |
| *H01R 12/00* | (2006.01) |

(52) U.S. Cl.

CPC ..... *H01R 13/44* (2013.01); *H01R 12/7082* (2013.01); *H01R 9/091* (2013.01)

USPC ..... 439/660

(58) Field of Classification Search

USPC ..... 439/660, 74

See application file for complete search history.

(56) References Cited

U.S. PATENT DOCUMENTS

| | | | | |
|---|---|---|---|---|
| 3,760,335 | A * | 9/1973 | Roberts | 439/398 |
| 4,653,838 | A | 3/1987 | Ney et al. | |
| 4,734,060 | A * | 3/1988 | Kawawada et al. | 439/660 |
| 5,181,855 | A * | 1/1993 | Mosquera et al. | 439/74 |
| 6,007,361 | A | 12/1999 | Flachslaender | |
| 6,152,754 | A | 11/2000 | Gerhardt et al. | |
| 2006/0094307 | A1 | 5/2006 | Woelfl et al. | |

FOREIGN PATENT DOCUMENTS

| | | |
|---|---|---|
| EP | 0060644 A1 | 9/1982 |
| EP | 0186572 A2 | 7/1986 |

* cited by examiner

*Primary Examiner* — Phuong Dinh

(57) ABSTRACT

The male connector (10) comprises a first connector body (14) comprising electrical contacts (54, 56) extending towards the free insertion end (44) of the first connector body (14) and provided with free end portions (58) that are elastically deformable. The first connector body (14) comprises a plug portion (18) extending in the insertion direction and being provided with first hook-like extensions (46) at its free ends extending laterally outward. The hook-like extensions (46) cover the free end portions (58) of the electrical contacts (54, 56) of the first connector body (14) which are elastically biased outwardly to engage the first hook-like extensions (46). Moreover, the female connector (12) comprises a second connector body (16) with electric contacts (98, 100) extending towards the insertion end and being provided with free end portions (104) which are elastically deformable. The second connector body (16) comprises a socket portion (72) enclosing the electrical contacts (98, 100) and comprising the insertion opening, the edge (90) defining this opening being provided with further hook-like extensions (92) extending radially inward.

8 Claims, 4 Drawing Sheets

MALE CONNECTOR, FEMALE CONNECTOR AND CONNECTOR ARRANGEMENT

FIELD OF THE INVENTION

The invention relates to the field of connectors, especially to a male connector, a female connector and a connector arrangement comprising such a male connector and a female connector.

BACKGROUND OF THE INVENTION

Connectors are used in various applications for connecting electrical components to submit electrical energy or data between these components. Such connectors can be used to connect different electric apparatuses mutually as stand-alone units, to connect each of these stand-alone units with a power grid for power supply or to provide a connection between such units to form a network for data exchange.

To provide a realiable electric connection even under heavy duty conditions, the electrical contacts may be comprised within a connector body that protects the damageable tips of the electrical contacts. This is especially the case with connectors for providing a data exchange connection, which may comprise a large number of electrical contacts that can easily be damaged when the different connector parts are plugged together. Usually, such a connector can be provided as a male connector comprising a connector body, which is provided to be inserted into a second connector body of a female connector, or as a respective female connector provided with a reception to receive another connector body of a male connector.

As stated above, it is advantageous to arrange the electrical contacts inside the respective male and female connectors such that their tips are protected from being damaged. For example, documents U.S. Pat. No. 6,007,361 discloses a connector arrangement comprising two connector parts, the male connector body comprising a central plug portion with the electric contacts being arranged to both sides of the plug portion. On the contrary, the female connector part comprises a socket portion to receive the plug portion, the electrical contacts of the female connector body being arranged on the side walls on the inside of the socket portion. When both connector parts are plugged together, the electrical contacts engage each other by sliding along their respective surfaces. The connector of the above kind represents a universal connector for connecting different electric units for medical use, i.e. for establishing a data connection and power supply between different components of a system for monitoring vital functions of a patient. It is obvious that in this field of use, a high relability of the data connection has a high priority. The connector arrangement according to this document also comprises means for securing the two connector parts with each other.

Although the problem of establishing a reliable mechanical connection between the two connector bodies is satisfactory solved by this arrangement, there remains the problem of damaging the tips of the electrical contacts when the two connector parts are pushed together. A small disalignment of the tips of the contacts can be enough to cause an unwanted interference of the ends of the contacts so that they are distorted or the like. If one electrical contact of a first connector is damaged once, the damage can be spread by connecting this first connector to another connector, because the damaged contact can further damage other contacts in the respective complementary connector in another connector arrangement.

SUMMARY OF THE INVENTION

It is an object of the invention to provide a connector in which the electrical contacts are satisfactory protected from being damaged when this connector is connected with another connector, without impairing the overall design of the connector or its user friendliness. Moreover, it is a particular object of the present invention to provide a male connector and a female connector with a complementary design, that can be mutually connected to form a connector arrangement in which the electrical contacts of the male and female connector are protected sufficiently even when used incautiously or under heavy duty conditions.

These objects are achieved by a male connector comprising a first connector body (14) provided to be inserted into a second connector body (16) of a female connector (12), the first connector body (14) comprising electrical contacts (54, 56) extending towards the free insertion end (44) of the first connector body (14) and being provided with free end portions (58) that are elastically deformable, and a plug portion (18) extending in the insertion direction of the first connector body (14), the plug portion (18) being provided with first hook-like extensions (46) at its free end extending radially outward, the first hook-like extensions (46) being arranged to cover the free end portions (58) of the electrical contacts (54, 56) of the first connector body (14) which are elastically biased outwardly to engage the first hook-like extensions (46), a female connector comprising a second connector body (16) provided to receive a first connector body (14) of a male connector (10) by insertion into the second connector body (16), the second connector body (16) comprising electrical contacts (98, 100) extending towards the free insertion end of the second connector body (16) and being provided with free end portions (104) that are elastically deformable, the second connector body (16) comprising a socket portion (72) enclosing the electrical contacts (98, 100) and comprising an insertion opening at its free insertion end, the edge (90) defining the opening being provided with second hook-like extensions (92) extending radially inward, the second hook-like extensions (92) being arranged to cover the free end portions (104) of the electrical contacts (98, 100) of the second connector body (16) which are elastically biased inwardly to engage the second hook-like extensions (92) and a connector arrangement comprising a male connector (10) being provided to be inserted into a second connector body (16) of a female connector (12) so that the respective electrical contacts (98, 100) of a first connector body (14) and the second connector body (16) engage with each other.

A male connector according to the present invention comprises a first (male) connector body, which is provided to be inserted into a second (female) connector body of a female connector. Once being connected, these male and female connectors form a connector arrangement, wherein the respective electrical contacts of the male and female connector engaged with each other, establishing an electrical connection.

The connector body of the male connector comprises electrical contacts extending towards the free end of the connector body which is provided to be inserted into the female connector body of the other connector. The electrical contacts are provided with free end portions which are elastically deformable. The male connector comprises a plug portion extending in the insertion direction and which is provided with hook-like extensions at its free end extending radially outward, i.e. in a direction perpendicular to the insertion direction. In one possible arrangement, hook-like extensions extend to both sides of the plug portion.

These hook-like extensions are arranged to cover the free tips or end portions of the electrical contacts. The contacts are elastically biased outwardly to engage the hook-like extensions. This engagement can be provided by a contact between the tips of the electrical contacts and dentations forming the ends of the hook-like extensions.

Viewed from the free insertion end of the male connector body, the tips of the electrical contacts lie behind the hook-like extensions and are protected from any interference or mechanical damage. The outer side surfaces of the electrical contacts are still free to be contacted by a complementary electrical contact of the female connector. When the male connector and the female connector are pushed together, the side surfaces of the female electrical contacts can slide of the respective side surfaces of the male electrical contacts, establishing the electric connection. However, there is no danger of an abutment or any interference of the damageable tips of the contacts.

According to one preferred embodiment of this male connector, the plug portion of the first connector body comprises a narrowing portion that narrows its cross-section towards the insertion end of the plug portion. This narrowing portion is defined by wedge surfaces of the electrical contacts of the first connector body in the assembled state of the first and second connector bodies.

In one preferred embodiment, the plug portion comprises a central plug member that is inserted between two wedge members, wherein the central plug member extends beyond the ends of the wedge members and carries the hook-like extension at its free end. The electrical contacts are then arranged at both sides of the wedge members.

This embodiment represents a modular arrangement of the plug portion consisting of the central plug member and the wedge members at both sides, carrying the electrical contacts on their side surfaces.

In another preferred embodiment, the free end portions of the electrical contacts of the first connector body are provided with outwardly curved sections.

These curved sections help to improve the engagement between the electrical contact of the first connector and the complementary electrical contact of the second connector, which may also be provided with such a curved section. The respective curved sections slide along each other when the mechanical connection between the first and second connector is established.

According to a second aspect of the present invention, a female connector comprises a second (female) connector body provided to receive a first (male) connector body by insertion into the second connector body. The electrical contacts of this second connector body extend towards the free insertion end and are provided with free end portions which are elastically deformable. Unlike the first connector body described above, the second connector body comprises a socket portion enclosing the electrical contacts and comprising an insertion opening at its free insertion end. The edge defining this opening is provided with hook-like extensions extending radially inward. These second hook-like extensions are arranged to cover the free end portions of the electrical contacts of the second connector body, which are elastically biased inwardly to engage the second hook-like extensions.

The hook-like extensions protect the tips of the electrical contacts of the second connector body, like the first hook-like extensions on the plug portion of the first connection body as described according to the first aspect of the present invention. The first and second connectors have therefore in common that they are both provided with hook-like extensions at their mating portions for insertion/reception of the respective other connector body, the respective hook-like extensions forming a cover for the tips of the electrical contacts. At the second connector, the second hook-like extensions surround the insertion opening of the socket portion.

In a preferred embodiment of this female connector, its socket portion comprises a widening portion, that widens the free cross section within the socket portion towards the insertion opening of the socket portion. This widening portion is defined by wedge surfaces for supporting the electrical contacts of the second connector body in the assembled state of the first connector body and the second connector body.

When the male and female connector are assembled, the electrical contacts of the female connector are supported by the wedge surfaces at their back sides to delimit their bending movement in the outward direction, so that a reliable seat for the electrical contact is created.

According to another preferred embodiment of the female connector, the socket portion comprises wedge members forming inner walls of the socket portion and being inserted into a surrounding socket member that forms outer walls of the socket portion, said surrounding socket member extending beyond the ends of the wedge members and providing the edge defining the insertion opening, said wedge members providing the wedge surfaces of the widening portion, the electrical contacts of the second connector body being arranged on the inner walls formed by the wedge members.

Preferrably, the free end portions of the electrical contacts of the second connector body are provided with inwardly curved sections.

According to a third aspect of the present invention, a connector arrangement comprises a male connector as described above and a female connector, the first connector body of the male connector being provided to be inserted into the second connector body of the female connector so that the respective electrical contacts of the first and second connector bodies engage with each other.

According to a preferred embodiment of this connector arrangement, the first connector body comprises a female receiving portion surrounding the plug portion and being provided to receive the socket portion of the second connector body.

This female receiving portion is provided as a mechanical seat receiving the socket portion and giving more strength to the mechanical reception between the different connectors of the arrangement.

BRIEF DESCRIPTION OF THE DRAWINGS

These and other aspects of the invention will be apparent from and elucidated with reference to the embodiments described hereinafter.

In the drawings.

DETAILED DESCRIPTION OF EMBODIMENTS

Figure 1:
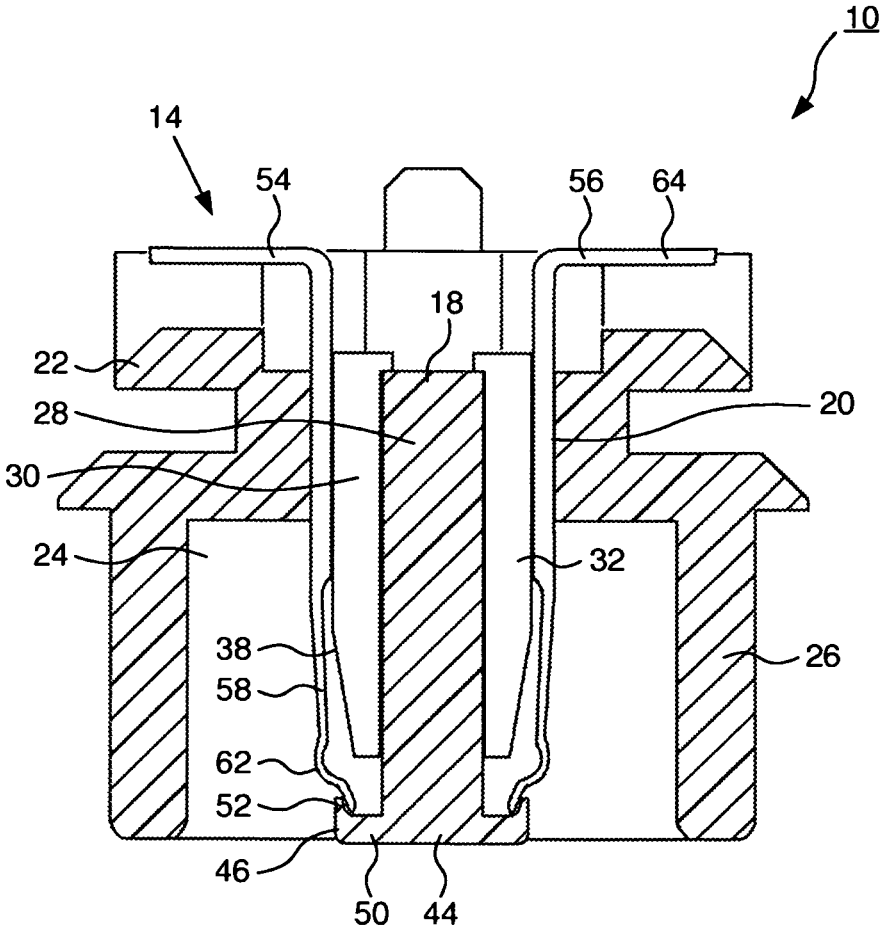
FIG. 1 shows a cross section of a male connector according to one embodiment of the present invention.
Figure 2:
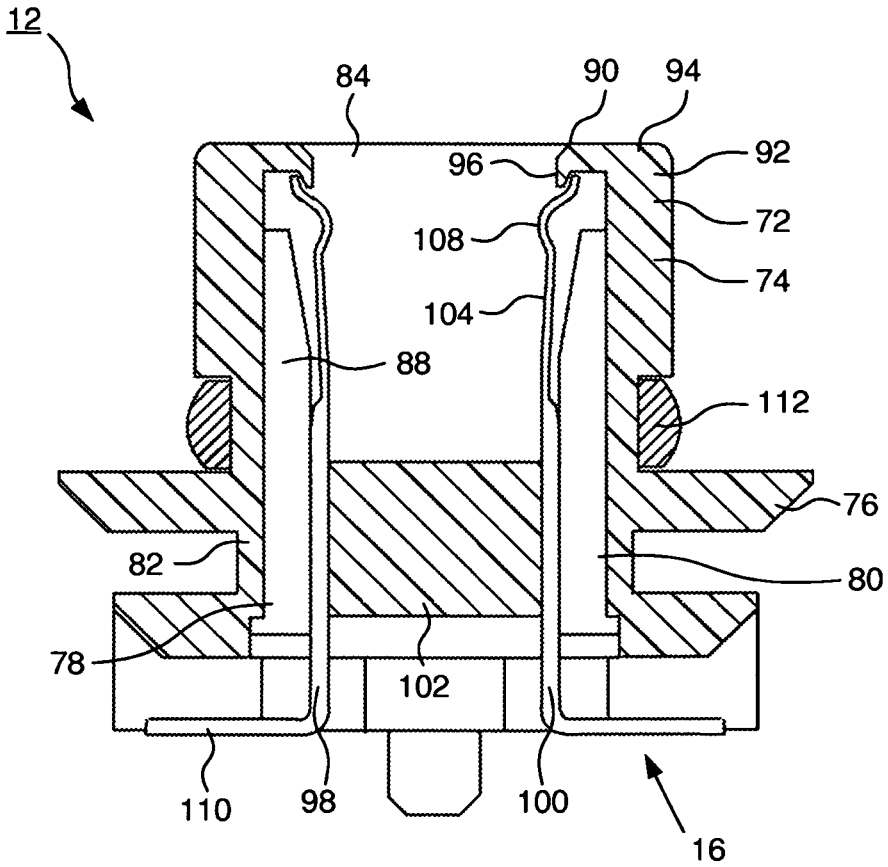
FIG. 2 shows a cross section of a female connector according to one embodiment of the present invention, said female connector being provided to be connected with the male connector according to FIG. 1.

The connector arrangement according the present invention comprises a male connector 10 shown in FIG. 1 and a female connector 12 shown in FIG. 2. The male connector and the female connector 12 are connectable by pushing their respective connector bodies together so that electrical contacts comprised within the respective connector bodies engage with each other. In the present case the male connector 10 and the female connector 12 are provided as connectors of electric units for medical use. For example, the connector arrangement according to FIGS. 3 and 4 can be used to establish a data connection for data exchange between different electric stand-alone units.

In the following the male connector 10 shall be described with respect to FIG. 1. This male connector 10 comprises a connector body generally denoted by reference number 14 and being described as a first connector body 14 in the following. This first connector body 14 is provided to be inserted into a second connector body 16 of the female connector 12 according to FIG. 2. The insertion direction of the first connector body 14 corresponds to the vertical direction in FIG. 1, i.e. the first connector body 14 is pushed downwards to be plugged into the second connector body 16.

The first connector body 14 is built symetrically with respect to a central axis corresponding to the insertion direction, i.e. standing vertically in FIG. 1. On this central axis a plug portion 18 is arranged, forming a central male portion of the first connector body 14. The plug portion 18 is received within an opening 20 within a massive base portion 22 of the first connector body 14 and extends downward from the base portion 22 into a void 24 that is delimited by outer side walls 26 of the first connector body 14. These outer side walls 26 form a female receiving portion 26.

The plug portion 18 mainly comprises three parts, namely a central plug member 28 and two wedge members 30, 32 extending from the base portion 22 in the insertion direction. More specifically, the plug member 28 is inserted between the two wedge members 30, 32, all three elements 28, 30, 32 being fitted into the opening 20 in the base portion 22 and extending from there into the void 24. In their extension direction, the two wedge members 30, 32 narrow towards their ends forming wedge surfaces 38 in this narrowing portion. With other words, the cross-section of the two wedge members 30, 32 becomes smaller towards their ends. On the contrary, the central plug member keeps its cross-section from the opening along the whole extension length of the wedge members 30, 32.

The wedge surfaces 38 define a narrowing portion of the plug portion 18 within the void 24, whereby the cross-section of the plug portion 18 decreases in the insertion direction. The plug member 28 extends beyond the ends of the wedge members 30, 32 so that the plug portion 18 comprises a free insertion end 44 being formed by a free end of the central plug member 28. At this free insertion end 44, the plug member 28 comprises hook-like extensions 46 extending laterally to both sides of the plug portion 18, i.e. in a direction perpendicular to the insertion direction. These hook-like extensions 46 are formed integrally with the plug member 28.

Each of the hook-like extensions 46 comprises a flat wall portion 50 extending laterally and a dentation 52 extending from the lateral end of the flat wall portion 50 in the direction for the base portion 22, i.e. against the insertion direction. Generally, the cross-section of the plug portion 18 is shaped like a mushroom that has been turned over, its cap being formed by the insertion end 44 with the hook-like extensions 46.

To both sides of the plug portion, electrical contacts 54, 56 extend through the opening 20 in the base portion 22 along the wedge members 30, 32 towards the insertion end 44 of the plug portion 18. Starting from the back side of the base portion 22 opposed to the insertion end 44, the electrical contacts 54, 56 extend into the opening 20 in close contact to both sides of the wedge members 30, 32. Inside the void 24, the electrical contacts 54, 56 comprise free end portions 58 that are spaced apart from the wedge surfaces 38 and are elastically deformable. That is, the free end portions 58 can be deflected towards the plug portion 18 until they get into contact with the wedge portions 38. The wedge portions 38 have the function of a support for the respective electrical contact 54, 56 in the deflected state.

The tips of the electrical contacts 54, 56 lie behind the dentations 52 of the hook-like extensions 46 so that the free end portions 58 are elastically biased outwardly to engage the dentations 52 of the hook-like extensions 46. Due to this engagement, the free end portions 58 of the electrical contacts 54, 56 are slightly inclined inwardly along the insertion direction of the male connector 10.

Near the tips the electrical contacts 54, 56 comprise outwardly curved sections 62 to improve the engagement of the electrical contacts 54, 56 with the electrical contacts of a female connector, which will be described later. On the backside of the base portion 22 opposite to the freeinsertion end 44, the electrical contacts 54, 56 comprise angular sections 64 to be connected to a conductor of a cable or the like as it is known from the state of the art.

In the following the female connector 12 will be described with respect to FIG. 2. The female connector 12 comprises the second connector body 16 provided to receive the first connector body of the male connector 10 by insertion of the first connector body 14 into the second connector body 16. For this reason, the second connector body 16 can also be understood as a female connector body receiving the male first connector body 14.

The second connector body 16 comprises a socket portion 72 formed by an outer socket member 74, that is formed integrally with a base portion 76 of the second connector body 16, and inner wedge members 78, 80 of the socket portion 72, the wedge members 78, 80 forming inner walls of the socket portion 72. The wedge members 78, 80 extend from the backside of the female connector 12, i.e. from the side opposite to its insertion end through an opening 82 in the base portion 76 into the reception space 84 enclosed by the socket portion 72. Within this reception space 84, the wedge members 78, 80 comprise narrowing portions that narrow their cross section towards the insertion ends of the wedge members 78, 80. The narrowing portions of the wedge members 78, 80 are defined inwardly by wedge surfaces 88, delimiting a widening portion of the reception space 84 within the socket portion 72 that widens the free cross section, i.e. the reception space 84 within the socket portion 72 towards the insertion end of the female connector 12.

The surrounding socket member 74 extends towards the insertion end of the female connector 12 beyond the ends of the wedge members 80 and provides an edge 90 defining an opening of the socket portion 72. More specifically, this edge 90 defining the insertion opening is provided with hook-like extensions 92 extending laterally inward and facing each other at the opposite sides of the socket portion 72. Each of these hook-like extensions 92 comprises a wall portion 94 extending laterally and a dentation 96 at the backside of the wall portion 94, extending towards the base portion 76. Generally speaking, the hook-like extensions 92 of the second connector body 16 of the female connector body 12 correspond to the cross-section of the hook-like extensions 46 of the plug portion 18 of the first connector body 14. This also stands for the wedge members 78, 80 of the second connector body 16, corresponding mainly to the cross-section of the wedge members 30, 32 provided within the first connector body 14 of the male connector 10.

Like in the male connector 10 described above, electrical contacts 98, 100 are provided within the second connector body 16 and extend from the back portion of the second connector body 16 through the base portion 76 into the reception space 84 within the socket portion 72. Within the base portion 76, the electrical contacts 98, 100 are fitted into the second connector body 16 by a central plug member 102 so that the electrical contacts 98, 100 lie between the plug member 102 and the wedge members 78, 80. Within the widening portion of the second connector body 16, defined by the wedge surfaces 88, the electrical contacts 98, 100 comprise free end portions 104 that are elastically deformable and spaced from the wedge surfaces 88 so that they can be deflected outwardly until they are supported by the wedge surfaces 88.

The tips of the electrical contacts 98, 100 engage with the dentations 96 of the hook-like extension 92 because of the biasing force of the free end portions 104 that bias the tips in an inward direction. Moreover, the free end portions 104 are provided with inwardly curved sections 108, corresponding to the outwardly curved sections 62 of the electrical contacts 54, 56 of the male connector 10. The electrical contacts 98, 100 of the female connector 12 are provided with angular end portions 110 at the backside of the base portion 76 to be connected with a conductor of a cable or the like.

Figure 3:
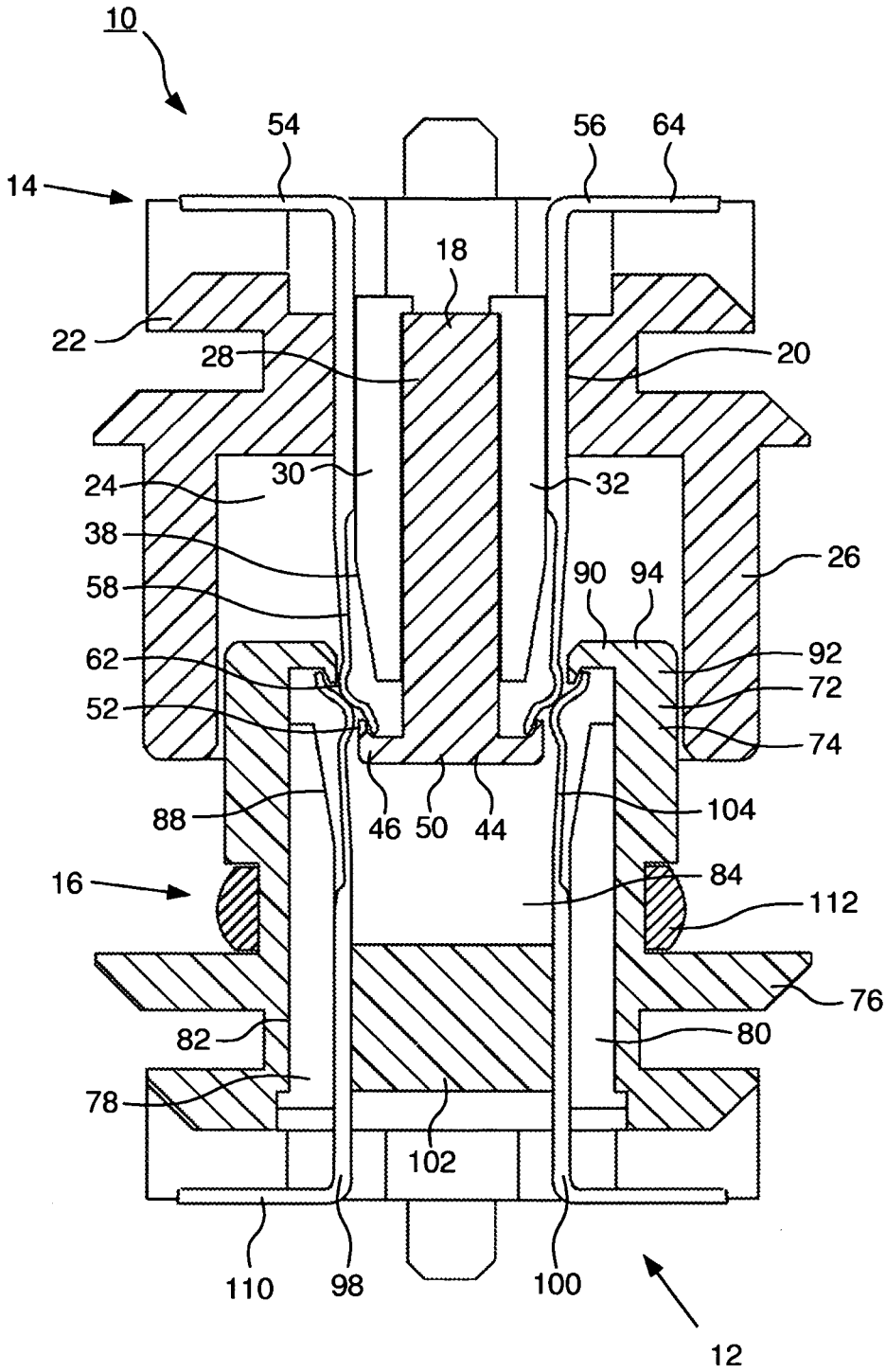
FIG. 3 shows a cross section of a connector arrangement comprising the male connector according to FIG. 1 and the female connector according to FIG. 2 in an unplugged state.
Figure 4:
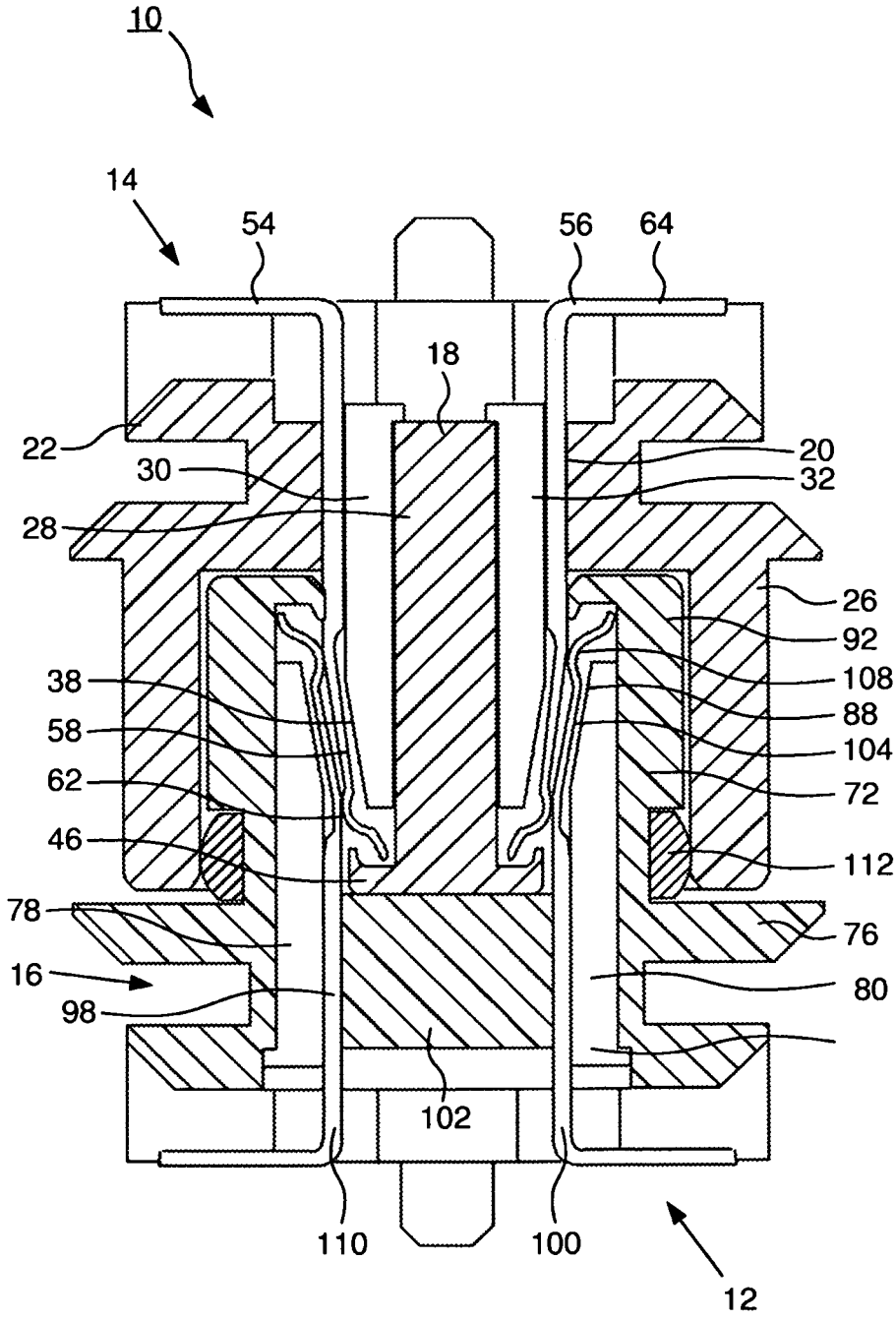
FIG. 4 shows the connector arrangement according to FIG. 3 in a connected state, wherein the male connector is completely inserted into the female connector to establish an electric connection.

The insertion opening of the socket portion 72 has a cross section wide enough to receive the insertion end 44 of the first connector body 14 of the male connector 10 so that the plug portion 18 can be shifted into the reception space 84 within the socket portion 72, like it is shown in FIGS. 3 and 4. Moreover, the lateral cross-section of the void 24 within the female receiving portion 26 of the first connector body 14 is wide enough to receive the socket portion 72. On its outside, the surrounding socket member 72 comprises a seal member 112, that provides a tight fitting connection between the socket member 72 and the inner walls of the female receiving portion 26.

Viewed from the insertion end 44 in the direction towards the base portion 22 of the first connector body 14, the tips of the electrical contacts 54, 56 are covered by the hook-like extensions 46 at the insertion end 44 of the plug portion 18. This means that the tips are protected against being damaged when the male connector 10 is connected with the female connector 12. On the other hand, the lateral sides of the electrical contacts 54, 56 within the void 24 at both sides of the plug portion 18 are free to be contacted by the respective electrical contacts 98, 100 of the female connector 12. This can be taken from FIG. 3, showing that the outwardly curved sections 62 of the electrical connectors 54, 56 can easily get into contact with the inwardly curved sections 108 of the electrical contacts 98, 100 when the plug portion 18 is pushed into the socket portion 72. In the contact situation shown in FIG. 3, further pushing of the male connector 10 and female connector 12 will cause the electrical contacts 54, 56 and 98, 100 to be slightly deflected against their restoring force. When the outwardly curved sections 62 and inwardly curved sections 108 have passed each other, like it is shown in FIG. 4, the respective free end portions 58, 104 of the electrical contacts 54, 56, 98, 100 can further be biased laterally inward and outward, respectively, against the dentations 52, 96 of the hook-like extensions 46, 92. When the connection between the male connector and the female connector 12 is established, the insertion end 44 of the plug portion 18 the plug member 102, and the female receiving portion 26 encloses the socket portion 72 completely. In this situation the free ends 58 of the electrical contacts 54, 56 are supported by the wedge surfaces 38 of the wedge members 30, 32 and the free ends 104 of the electrical contacts 98, 100 of the female connector 12 are supported by the wedge surfaces 88 of the wedge members 78, 80 in the socket portion 72.

It is obvious from the above description and the corresponding figures that the damageable tips of the electrical contacts 64, 56, 98, 100 are securely protected by the respective hook-like extensions 46, 92 from getting into contact with the respective other tips of the electrical contacts of the other connector, while a reliable electrical connection between the electrical contacts of the connector arrangement can easily be established at the side surfaces of the electrical contacts 54, 56, 98, 100 that slide onto each other when the male connector 10 and the female connector 12 are pushed together. This means that the mechanical and electrical connection in the connector arrangement shown in FIG. 4 can be established easily and securely without any danger to damage the electrical contacts 54, 56, 98, 100.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A male connector, comprising a first connector body provided to be inserted into a second connector body of a female connector, said first connector body comprising electrical contacts extending towards the free insertion end of said first connector body and being provided with free end portions that are elastically deformable, and a plug portion extending in the insertion direction of said first connector body, said plug portion being provided with first hook-like extensions at its free end extending radially outward, said first hook-like extensions being arranged to cover the free end portions of the electrical contacts of said first connector body which are elastically biased outwardly to engage said first hook-like extensions, wherein said plug portion of said first connector body comprises a narrowing portion that narrows its cross section towards the insertion end of said plug portion, said narrowing portion being defined by wedge surfaces for supporting the electrical contacts of said first connector body in the assembled state of said first connector body and a second connector body.

2. The connector according to claim 1, wherein said plug portion comprises a central plug member inserted between two wedge members, said central plug member extending beyond the ends of the wedge members and carrying said first hook-like extensions at its free end, the electrical contacts of said first connector body being arranged to both sides of said wedge members.

3. The connector according to claim 1, wherein the free end portions of the electrical contacts of said first connector body are provided with outwardly curved sections.

4. A female connector, comprising a second connector body provided to receive a first connector body of a male connector by insertion into said second connector body, said second connector body comprising electrical contacts extending towards the free insertion end of said second connector body and being provided with free end portions that are elastically deformable, said second connector body comprising a socket portion enclosing the electrical contacts and comprising an insertion opening at its free insertion end, the edge) defining said opening being provided with second hook-like extensions extending radially inward, said second hook-like extensions being arranged to cover the free end portions of the electrical contacts of said second connector body which are elastically biased inwardly to engage said second hook-like extensions wherein said socket portion of said second connector body comprises a widening portion that widens the free cross section within said socket portion towards the insertion opening of said socket portion, said widening portion being defined by the wedge surfaces for supporting the electrical contacts of said second connector body in the assembled state of said first connector body and said second connector body.

5. The connector according to claim 4, wherein said socket portion comprises wedge members forming inner walls of said socket portion and being inserted into a surrounding socket member that forms outer walls of said socket portion, wherein said surrounding socket member extends beyond the ends of the wedge members and provides the edge defining said insertion opening, said wedge members providing the wedge surfaces of said widening portion, the electrical contacts of said second connector body being arranged on the inner walls formed by said wedge members.

6. The connector according to claim 4, wherein the free end portions of the electrical contacts of said second connector body are provided with inwardly curved sections.

7. A connector arrangement, comprising a male connector according to claim 1 and a female connector according to claim 4, the first connector body of said male connector being provided to be inserted into the second connector body of said female connector so that the respective electrical contacts of said first connector body and said second connector body engage with each other.

8. The connector arrangement according to claim 7, wherein said first connector body comprises a female receiving portion surrounding said plug portion and being provided to receive the socket portion of said second connector body.

* * * * *